United States Patent [19]

Land

[11] 4,329,411

[45] May 11, 1982

[54] MULTICOLOR DIFFUSION TRANSFER PRODUCTS

[75] Inventor: Edwin H. Land, Cambridge, Mass.

[73] Assignee: Polaroid Corporation, Cambridge, Mass.

[21] Appl. No.: 132,424

[22] Filed: Mar. 21, 1980

Related U.S. Application Data

[63] Continuation of Ser. No. 537,124, Dec. 30, 1974, abandoned.

[51] Int. Cl.[3] ..... G03C 7/00

[52] U.S. Cl. ..... 430/30; 430/220; 430/236; 430/359; 430/507; 430/513; 430/517

[58] Field of Search ..... 430/30, 220, 357, 359, 430/507, 211

[56] References Cited

U.S. PATENT DOCUMENTS

| | | | |
|---|---|---|---|
| 2,571,697 | 10/1951 | Evans | 430/30 |
| 3,184,307 | 5/1965 | Letzer | 430/30 |
| 3,415,644 | 12/1968 | Land | 430/212 |
| 3,547,640 | 12/1970 | Becket et al. | 430/504 |
| 3,672,898 | 6/1972 | Schwan et al. | 430/507 |
| 3,685,900 | 8/1972 | Kirby et al. | 430/30 |
| 3,819,376 | 6/1974 | Land | 430/30 |
| 3,854,945 | 12/1974 | Bush et al. | 430/244 |
| 3,990,898 | 11/1976 | Land | 430/30 |

FOREIGN PATENT DOCUMENTS

| | | |
|---|---|---|
| 928559 | 6/1973 | Canada . |
| 631873 | 11/1949 | United Kingdom . |

OTHER PUBLICATIONS

"Neutralizing Materials . . . ", *Research Disclosure,* No. 12331, 7/74, pp. 20 and 21.

*Primary Examiner*—J. Travis Brown
*Attorney, Agent, or Firm*—Stanley H. Mervis

[57] ABSTRACT

The sensitometric properties of multicolor diffusion transfer film units may be modified after the photosensitive element has been coated. Sensitometric modification is effected by a photoexposure through a layer of a color correction dye(s). In a preferred embodiment, the color correction dye(s) is bleachable and is contained in a layer over the image-receiving layer.

3 Claims, 2 Drawing Figures

MULTICOLOR DIFFUSION TRANSFER PRODUCTS

Figure 1:
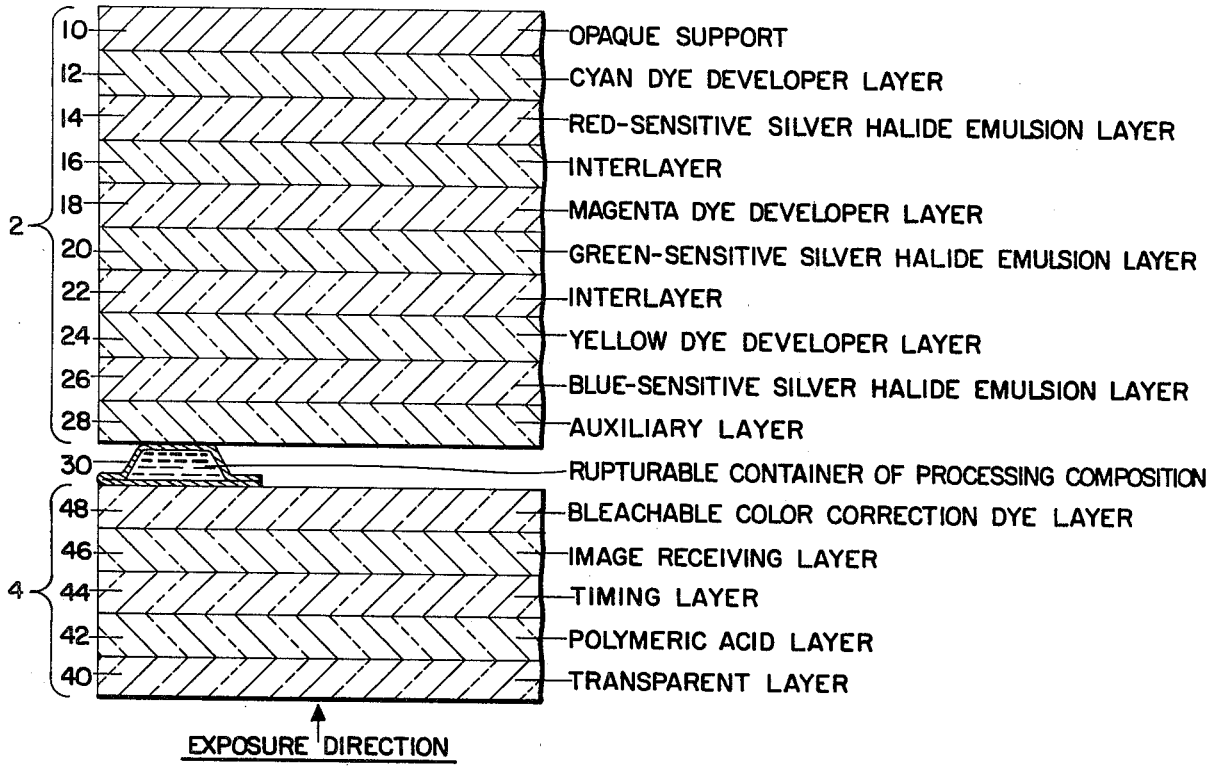

This is a continuation of application Ser. No. 537,124, filed Dec. 30, 1974, now abandoned.

This invention is concerned with photography and, more particularly, with the formation of multicolor photographic images.

It is well known that photographic films, and especially multicolor films, may and generally do vary from lot to lot, notwithstanding efforts to "repeat" previous films.

Manufacturers of multicolor photographic films have developed a number of procedures to minimize the effects upon the final multicolor image of unavoidable variations in the manufacturing operations. These variations are reflected primarily in shifts in color balance as reflected in mismatching of the D log E curves of the individual red, green and blue exposures. Equipment used to coat multicolor films is highly precise but variations between intended coverages of silver halide and/or the dye image-forming materials do occur. Repeat batches of silver halide emulsions may, and usually do, vary in their photographic response. Individual layers may be dried to slightly different degrees. Films are stored for a period of time after coating to allow the films to "age", so that changes in sensitometry following coating have an opportunity to reach a plateau prior to sale. If the film is designed to be achieved by a photofinisher or in a darkroom, processing of the exposed multicolor film is controlled within very narrow limits, typically within plus or minus a half degree of a prescribed temperature, in order to minimize sensitometric variations from film to film. Where the multicolor film is of the negative type, an opportunity to adjust the sensitometry occurs in printing the desired final positive image, during which operation the printing exposure may be appropriately color filtered.

Obviously the basic sources of sensitometric variations noted above exist also in multicolor diffusion transfer films, with the added complication that once the film is shipped, the sensitometric properties are essentially fixed. The opportunity for adjustment provided in darkroom processing, practically speaking, is unavailable for users of self-developing films. While professional and advanced amatuer photographers may be skillful enough to utilize color correction filters to least partially "rebalance" the color balance, ordinary users of the film would only be confused by such additional operations.

The present invention is directed to this problem. A primary object of this invention is to provide a simple and economical method of modifying the sensitometry of a diffusion multicolor film subsequent to the manufacture of the photosensitive component thereof.

A further object of this invention is to provide multicolor diffision transfer films, wherein a layer of a dye, preferably a dye bleachable by the processing composition, is so positioned that photoexposure is effected therethrough, whereby said dye layer is effective as a color correction filter.

Other objects of this invention will, in part, be obvious and will, in part, appear hereinafter.

The invention accordingly comprises the method involving the several steps and the relation and order of one or more of such steps with respect to each of the others, and the product possessing the features, properties and the relation of components which are exemplified in the following detailed disclosure, and the scope of the application of which will be indicated in the claims.

Figure 2:
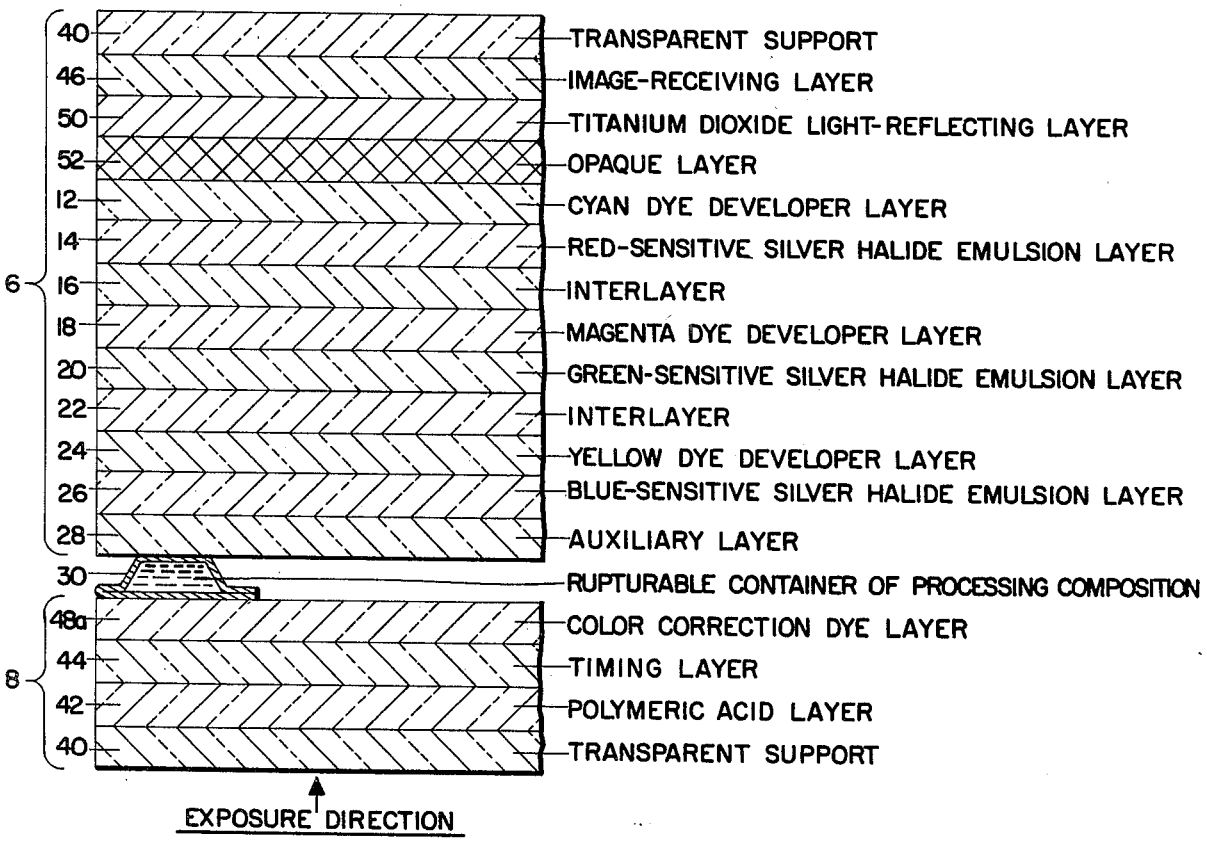

For a fuller understanding of the nature and objects of the invention, reference should be had to the following detailed description taken in connection with the accompanying drawings wherein:

FIG. 1 is a diagrammatic, enlarged cross-sectional view of a diffusion transfer film incorporating a bleachable color correction dye in accordance with the present invention; and FIG. 2 is a diagrammatic, enlarged cross-sectional view of another diffusion transfer film incorporating a color correction dye in accordance with the present invention.

The present invention, as noted above, is concerned with modifying the sensitometry of multicolor photosensitive elements utilized in diffusion transfer processes. The resulting multicolor transfer image may be separated from the developed photosensitive element, or it may be retained therewith as part of a permanent laminate providing an integral negative-positive reflection print. The image-dye providing materials preferably are dye developers, but it will be expressly understood that the invention is not limited to films employing dye developers and is applicable to diffusion transfer processes using any type of image dye or image dye intermediate. For convenience, the present invention will be described in more detail in connection with the use of integral negative-positive reflection print films utilizing dye developers.

In such integral negative-positive reflection prints, the image-carrying layer is separated from the developed silver halide emulsions in said laminate by a light-reflecting layer, preferably a layer containing titanium dioxide. Illustrative of patents describing such products and processes are U.S. Pat. No. 2,983,606 issued Mar. 9, 1961 to Howard G. Rogers, U.S. Pat. Nos. 3,415,644, 3,415,645 and 3,415,646 issued Dec. 10, 1968 to Edwin H. Land, U.S. Pat Nos. 3,594,164 and 3,594,165 issued July 20, 1971 to Howard G. Rogers, and U.S. Pat. No. 3,647,437 issued Mar. 7, 1972 to Edwin H. Land.

Referring more specifically to the aforementioned U.S. Pat. No. 3,415,644, said patent discloses photographic products and processes employing dye developers wherein a photosensitive element and an image-receiving layer are maintained in fixed relationship prior to photoexposure and this fixed relationship is maintained after processing and image formation to provide a laminate including the processed silver halide emulsions and the image-receiving layer. Photoexposure is made through a transparent (support) element and application of a processing composition provides a layer of light-reflecting material to provide a white background for viewing the image and to mask the developed silver halide emulsions. The desired color transfer image is viewed through said transparent support against said white background.

The color characteristics and qualities of multicolor images are conventionally expressed in terms of the "H and D" or "D log E" curves of the blue, green and red exposure records contained in the multicolor image. "D log E" curves present the relationship of image density to the exposure resulting in the recorded image density, and the D log E curve is obtained by plotting the measured optical density against the logarithm of the exposure providing the measured density. Such curves may be readily plotted for diffusion transfer multicolor positive images, the maximum transfer density being a measure of the minimum exposure received by the silver halide and the lowest transfer density being a measure of the maximum exposure received by the silver halide. Customarily, the portion of minimum densities ($D_{min}$) of the D log E curve is referred to as the "toe" portion, and the portion of the curve reproducing maximum densities ($D_{max}$) is referred to as the "shoulder" portion. The portion of the D log E curve over which the gradient or slope of the curve is substantially constant, customarily referred to as the "straight-line" portion, is a measure of the exposure range over which the density is proportional to log E and this portion of the curve may be considered an indication of the latitude of the film.

In analyzing multicolor images for color quality, "reading" the blue, green and red D log E curves provides a means of expressing the relationship of these curves to each other, a relationship frequently referred to as color balance. If, for example, the skin tones appear greenish or bluish on visual inspection the extent of the apparent color imbalance may be quantitatively depicted by plotting the blue, green and red D log E curves on the same graph. In practice, integral blue, green and red reflection densities are used; these densities are called "integral" because they measure the total density at a given wavelength independent of the dye or dyes responsible for that density.

While the D log E curves are considered to be a measure of the effect of variations in exposure upon the final image density, in reality they measure the amount of each dye controlled by the photographic system. Photoexposure is, of course, the major source of this control. Variations in manufacturing steps and storage prior to use also may have significant effects upon the amount of silver halide developable during processing, thus affecting the final response characteristics of the silver halide emulsions in ways adversely affecting color balance.

It has been found that imbalances in the color sensitometry of a given diffusion transfer photographic system may be at least substantially, if not completely, reduced (corrected) by incorporating a color correction dye in a layer of the diffusion transfer film through which photoexposure is to be effected, the color correction dye being bleached during the subsequent diffusion transfer process or being so positioned as not to contribute dye density to the multicolor transfer image. Desirable changes in color balance thus may be readily effected by changes in one, two or all three of the individual red, green and blue H and D curves. Reliance upon modifications of the processing composition to offset imbalances in the color sensitometry of the photosensitive element itself are greatly reduced.

It will be recognized by those skilled in the art that effecting photoexposure through a layer containing such a color correction dye (or dyes) is effective to "filter", i.e., decrease, the exposure given to the silver halide layer(s) exposable by light absorbed by said color correction dye(s). While certain similarities to the conventional use of color correction filters placed in front of the camera lens will be readily apparent, the present invention permits exposure color correction of a more specific nature and without the inconvenience and handling difficulties associated with conventional color correction filters (e.g., scratches, fingerprints, limited density values, etc.). The requisite corrective action is taken prior to packaging of the film and the user is unaware of, and not involved in, the corrective action.

The correction dyes employed in the practice of this invention are colored during photoexposure but do not contribute dye density to the multicolor transfer image. In the preferred embodiments, the color correction dye will be bleached, i.e., rendered at least substantially colorless, as a result of contact with the processing composition employed to perform the diffusion transfer process. Bleachable color correction dyes may be bleached or decomposed by contact with aqueous alkali. Alternatively, a bleachable color correction dye may have its color "discharged" by reaction with a reducing agent, such as sodium sulfite. The "color discharged" color correction dye, or the product(s) of the bleaching thereof, should not be deleterious to the stability of the multicolor transfer image nor should they impart a stain to that image by absorbing visible light if they are present in, or capable of diffusing to, a layer which may be viewed as part of the transfer image.

Numerous dyes suitable for use as bleachable color correction dyes may be found in the anti-halation art, and such dyes per se form no part of the present invention. In those embodiments wherein the color correction dye layer through which photoexposure has been made is not part of the resulting multicolor transfer image, or where it is masked from view as in certain integral negative-positive reflection print structures, the color correction dye need not be bleached but should be non-diffusible to the image-receiving layer containing the multicolor transfer image. The requisite non-diffusion character may be provided by the use of a suitable mordant, by the use of long chain "ballast" or "anchor" substituents, by the omission of solubilizing groups, or by a combination of these and/or other art known techniques.

In practice, the color correction dye(s) may absorb light within a specific wavelength range, e.g., blue, green or red light, or within a combination of several wavelength ranges. Indeed, it may be desirable in a given instance to filter light of two different wavelength ranges in a ratio such that one silver halide emulsion receives more exposure filtration than does another.

The selection and incorporation of the color correction dye contemplated by this invention is most advantageously applied after the photosensitive element has aged to "maturity", i.e., the sensitometry of the photosensitive element as manufactured is no longer changing significantly with time. Indeed, the beneficial effects provided by this invention may be offset, in whole or in part, by aging changes if the color correction layer is provided before the photosensitive element has completed aging. In the same sense, the image-receiving system and the processing composition also should have reached their maturity prior to determining the desired color correction.

Color correction or "color compensating" filters for use in front of the camera lens are conventionally designated by a system which indicates the relative light absorption and thier color, e.g., a "CC-10M" filter is magenta in color and has one-half the density of a "CC-20M" filter. These filters may be used in the conventional manner as a convenient method of approximating the type and quantity of filtration which it would be desirable to provide. A layer containing the appropriate color correction dye(s) in a corresponding density may then be provided as a layer through which photoexposure is to be made, e.g., layer 48 of FIG. 1 and layer 48*a* of FIG. 2.

Multicolor diffusion transfer images may be obtained using a variety of arrangements of the image-receiving layer and the silver halide emulsions. Thus, these layers may be carried by a common support or by separate supports brought into superposition after photoexposure. A particularly advantageous film structure is shown in the aforementioned U.S. Pat. No. 3,415,644 wherein the requisite layers are in superposed relationship prior to and during photoexposure, and these layers are maintained in superposed relationship as a permanent laminate after processing and image formation. Such film units typically contain an outer transparent layer or support through which photoexposure is effected and the final multicolor image viewed, and another outer layer or support carrying at least the photosensitive layers, the latter support being opaque. While these supports or sheet-like elements may simply be held in superposed relationship, e.g., by a binding tape around the edges, in the preferred embodiment these elements are laminated together prior to photoexposure. This prelamination provides a number of benefits, both during manufacture and in photoexposure. Following exposure, the elements are delaminated by the distribution of a fluid processing composition which, upon solidification, bonds the elements together to form the desired permanent laminate. Procedures for forming such prelaminated film units wherein the two elements are temporarily laminated together prior to exposure are described, for example, in U.S. Pat. No. 3,625,281 to Albert J. Bachelder and Frederick J. Binda and U.S. Pat. No. 3,652,282 to Edwin H. Land, both issued Mar. 28, 1972, and in U.S. Pat. No. 3,793,023 issued to Edwin H. Land on Feb. 19, 1974.

Further description of the present invention may be facilitated by reference to the accompanying drawings wherein FIG. 1 and FIG. 2 illustrate two different transfer film units adapted to provide integral negative-positive reflection prints and employing dye developers as the image dyes.

FIG. 1 illustrates a diffusion transfer film unit comprising a photosensitive element or component 2, a rupturable container 30, and an image-receiving element or component 4. The photosensitive element 2 comprises an opaque support 10 carrying, in turn, a cyan dye developer layer 12, a red-sensitive silver halide emulsion layer 14, an interlayer 16, a magenta dye developer layer 18, a green-sensitive silver halide emulsion layer 20, an interlayer 22, a yellow dye developer layer 24, a blue-sensitive silver halide emulsion layer 26, and an auxiliary layer 28. The positive or image-receiving element 4 comprises a transparent support 40 carrying, in turn, a polymeric acid layer 42, a timing layer 44, an image-receiving layer 46, and a layer 48 of a bleachable color correction dye. The two elements are held in superposed, registered relationship, e.g., by a binding tape (not shown) so that photoexposure of the silver halide emulsion layers is effected through the layer 48 of the bleachable color correction dye. The rupturable container 30 contains a processing composition and is so positioned that, upon rupture the processing composition is distributed between the superposed elements 2 and 4. By including in the processing composition a light-reflecting pigment, preferably titanium dioxide, a light-reflecting layer may be provided against which the transfer image formed in the image-receiving layer 46 may be viewed. The developed photosensitive layers are masked from view by the light-reflecting layer and remain with the image-receiving layer 46 as part of a permanent laminate. The rupturable container 30 is of the type shown in U.S. Pat. No. 2,543,181 and is positioned adjacent the leading edge of the film unit.

In the processing of the film unit, the film unit is advanced relative to and between a pair of pressure-applying members which apply compressive pressure to the rupturable container 30 to eject its liquid contents between the photosensitive and image-receiving components 2 and 4 and then distribute the mass of liquid between the sheets toward the trailing ends thereof to form a layer of substantially uniform, predetermined thickness at least co-extensive with the image area. In order to insure sufficient processing liquid to form a layer of the required area and thickness between the sheets, excess processing liquid may be provided in container 30 and trapping means (not shown) provided for collecting and retaining excess processing liquid overrun.

In FIG. 2 there is illustrated another type of diffusion transfer film unit adapted to provide an integral negative-positive reflection print using dye developers as the image dyes. In this type of film unit, the image-receiving layer 46 and the photosensitive layers are carried by the same support. Thus, the photosensitive element 6 comprises a transparent support 40 carrying, in turn, an image-receiving layer 46, a light-reflecting layer 50 (e.g., a layer of titanium dioxide), an opaque layer 52 (e.g., a layer containing carbon black in a permeable binder), a cyan dye developer layer 12, a red-sensitive silver halide emulsion layer 14, an interlayer 16, a magenta dye developer layer 18, a green-sensitive silver halide emulsion layer 20, an interlayer 22, a yellow dye developer layer 24, a blue-sensitive silver halide emulsion layer 26, and an auxiliary layer 28. A spreader or processing sheet 8 comprises a transparent support 40 carrying, in turn, a polymeric acid layer 42, a timing layer 44, and a layer 48*a* of a color correction dye. The two elements are held in superposed, registered relationship as in the above-described film unit of FIG. 1, and photoexposure is effected through the layer 48*a* of color correction dye. Distribution of the processing composition from the rupturable container 30 provides a permanent laminate, with the transfer image in the image-receiving layer 46 being viewed against the preformed light-reflecting layer 50. Since the color correction dye layer 48*a* is masked from the view of one viewing the transfer image in the image-receiving layer 46, it is not necessary to bleach or decolorize the color correction dye so long as it does not diffuse to a layer in which it will be visible with the transfer image.

Details of the various layers of the illustrated film units may be found in the herein cited patents and need not be recited here. It will be noted that the polymeric acid layer 42 may be provided for the purpose of stabilizing the multicolor transfer image, the pH change provided by this or other art known acidifying or neutralizing layer may also be used to provide a pH which facilitates desired bleaching of the color correction dye or stabilizes the dye bleaching system to prevent regeneration of the same or a different undesirably colored material.

Processing of film units of the type described above is initiated by distributing the processing composition between predetermined layers of the film unit. In exposed and developed areas, the dye developer will be immobilized as a function of development. In unexposed and undeveloped areas, the dye developer is unreacted and diffusible, and this provides an imagewise distribution of unoxidized dye developer, diffusible in the processing composition, as a function of the point-to-point degree of exposure of the silver halide layer. The desired transfer image is obtained by the diffusion transfer to the image-receiving layer of at least part of this imagewise distribution of unoxidized dye developer. In the illustrated embodiments, the pH of the photographic system is controlled and reduced by the neutralization of alkali after a predetermined interval, in accordance with the teachings of the above noted U.S. Pat. No. 3,615,644, to reduce the alkalinity to a pH at which the unoxidized dye developer is substantially insoluble and non-diffusible. As will be readily recognized, the details of such processes form no part of the present invention but are well known; the previously noted U.S. patents may be referred to for more specific discussion of such processes.

Multicolor images may be obtained by providing the requisite number of differentially exposable silver halide emulsions, and said silver halide emulsions are most commonly provided as individual layers coated in superposed relationship. Film units intended to provide multicolor images comprise two or more selectively sensitized silver halide layers each having associated therewith an appropriate image dye-providing material providing an image dye having spectral absorption characteristics substantially complementary to the light by which the associated silver halide is exposed. The most commonly employed negative components for forming multicolor images are of the "tripack" structure and contain blue-, green-, and red-sensitive silver halide layers each having associated therewith in the same or in a contiguous layer a yellow, a magenta and a cyan image dye-providing material respectively. Interlayers or spacer layers may, if desired, be provided between the respective silver halide layers and associated image dye-providing materials or between other layers. Integral multicolor photosensitive elements of this general type are disclosed in U.S. Pat. No. 3,345,163 issued Oct. 3, 1967 to Edwin H. Land and Howard G. Rogers as well as in the previously noted U.S. patents, e.g., in FIG. 9 of the aforementioned U.S. Pat. No. 2,983,606.

A number of modifications to the structures described in connection with the figures will readily suggest themselves to one skilled in the art. Thus, for example, the multicolor multilayer negative may be replaced by a screen-type negative as illustrated in U.S. Pat. No. 2,968,554 issued Jan. 17, 1961 to Edwin H. Land and in the aforementioned U.S. Pat. No. 2,983,606 particularly with respect to FIG. 3 thereof.

The image dye-providing materials which may be employed in such processes generally may be characterized as either (1) initially soluble or diffusible in the processing composition but are selectively rendered non-diffusible in an imagewise pattern as a function of development; or (2) initially insoluble or non-diffusible in the processing composition but which are selectively rendered diffusible or provide a diffusible product in an imagewise pattern as a function of development. These materials may be complete dyes or dye intermediates, e.g., color couplers. The requisite differential in mobility or solubility may, for example, be obtained by a chemical action such as a redox reaction or a coupling reaction.

As examples of initially soluble or diffusible materials and their application in color diffusion transfer, mention may be made of those disclosed, for example, in U.S. Pat. Nos. 2,774,668; 2,968,554; 2,983,606; 3,087,817; 3,185,567; 3,230,082; 3,345,163; and 3,443,943. As examples of initially non-diffusible materials and their use in color transfer systems, mention may be made of the materials and systems disclosed in U.S. Pat. Nos. 3,185,567; 3,443,939; 3,443,940; 3,227,550; and 3,227,552. Many types of image dye-providing substances and film units useful therewith also are discussed in the aforementioned U.S. Pat. No. 3,647,437 to which reference may be made.

It is also to be understood that "direct positive" silver halide emulsions may also be used, depending upon the particular image dye-providing substances employed and whether a positive or negative color transfer image is desired.

A preferred opacification system to be contained in the processing composition to effect processing outside of a camera is that described in the above-mentioned U.S. Pat. No. 3,647,437, and comprises a dispersion of an inorganic light-reflecting pigment which also contains at least one light-absorbing agent, i.e., optical filter agent, at a pH above the pKa of the optical filter agent in a concentration effective when the processing composition is applied, to provide a layer exhibiting optical transmission density > than about 6.0 density units with respect to incident radiation actinic to the photosensitive silver halide and optical reflection density < than about 1.0 density units with respect to incident visible radiation.

In lieu of having the light-reflecting pigment in the processing composition, the light-reflecting pigment used to mask the photosensitive strata and to provide the background for viewing the color transfer image formed in the receiving layer may be present initially in whole or in part as a preformed layer in the film unit. As an example of such a preformed layer, mention may be made of that disclosed in U.S. Pat. No. 3,615,421 issued Oct. 26, 1971 and in U.S. Pat. No. 3,620,724 issued Nov. 16, 1971, both in the name of Edwin H. Land. The reflecting agent may be generated in situ as is disclosed in U.S. Pat. Nos. 3,647,434 and 3,647,435, both issued Mar. 7, 1972 to Edwin H. Land.

The dye developers (or other image dye-providing substances) are preferably selected for their ability to provide colors that are useful in carrying out subtractive color photography, that is, the previously mentioned cyan, magenta and yellow. They may be incorporated in the respective silver halide emulsion or, in the preferred embodiment, in a separate layer behind the respective silver halide emulsion. Thus a dye developer may, for example, be in a coating or layer behind the respective silver halide emulsion and such a layer of dye developer may be applied by use of a coating solution containing the respective dye developer distributed, in a concentration calculated to give the desired coverage of dye developer per unit area, in a film-forming natural, or synthetic, polymer, for example, gelatin, polyvinyl alcohol, and the like, adapted to be permeated by the processing composition.

Dye developers, as noted above, are compounds which contain the chromophoric system of a dye and also a silver halide developing function. By "a silver halide developing function" is meant a grouping adapted to develop exposed silver halide. A preferred silver halide development function is a hydroquinonyl group. Other suitable developing functions include ortho-dihydroxyphenyl and ortho-and para-amino substituted hydroxyphenyl groups. In general, the development function includes a benzenoid developing function, that is, an aromatic developing group which forms quinonoid or quinone substances when oxidized.

The image-receiving layer may comprise one of the materials known in the art, such as polyvinyl alcohol, gelatin, etc. It may contain agents adapted to mordant or otherwise fix the transferred image dye(s). Preferred materials comprise polyvinyl alcohol or gelatin containing a dye mordant such as poly-4-vinylpyridine, as disclosed in U.S. Pat. No. 3,148,061, issued Sept. 8, 1964 to Howard C. Haas.

In the various color diffusion transfer systems which have previously been described, and which employ an aqueous alkaline processing fluid, it is well known to employ an acid-reacting reagent in a layer of the film unit to lower the environmental pH following substantial dye transfer in order to increase the image stability and/or to adjust the pH from the first pH at which the image dyes are diffusible to a second (lower) pH at which they are not. For example, the previously mentioned U.S. Pat. No. 3,415,644 discloses systems wherein the desired pH reduction may be effected by providing a polymeric acid layer adjacent the dyeable stratum. These polymeric acids may be polymers which contain acid groups, e.g., carboxylic acid and sulfonic acid groups, which are capable of forming salts with alkali metals or with organic bases; or potentially acid-yielding groups such as anhydrides or lactones. Preferably the acid polymer contains free carboxyl groups. Alternatively, the acid-reacting reagent may be in a layer adjacent to the silver halide most distant from the image-receiving layer, as disclosed in U.S. Pat. No. 3,573,043 issued Mar. 30, 1971 to Edwin H. Land. Another system for providing an acid-reacting reagent is disclosed in U.S. Pat. No. 3,576,625 issued Apr. 27, 1971 to Edwin H. L and.

An inert interlayer or spacer layer may be and is preferably disposed between the polymeric acid layer and the dyeable stratum in order to control or "time" the pH reduction so that it is not premature and interferes with the development process. Suitable spacer or "timing" layers for this purpose are described with particularity in U.S. Pat. Nos. 3,362,819; 3,419,389; 3,421,893; 3,455,686; and 3,575,701.

While the acid layer and associated spacer layer are preferably contained in the positive component employed in systems wherein the dyeable stratum and photosensitive strata are contained on separate supports, e.g., between the support for the receiving element and the dyeable stratum; or associated with the dyeable stratum in those integral film units, e.g., on the side of the dyeable stratum opposed from the negative components, they may, if desired, be associated with the photosensitive strata, as is disclosed, for example, in U.S. Pat. Nos. 3,362,821 and 3,573,043. In film units such as those described in the aforementioned U.S. Pat. Nos. 3,594,164 and 3,594,165, they also may be contained on the spreader sheet employed to facilitate application of the processing fluid.

As is now well known and illustrated, for example, in the previously cited patents, the liquid processing composition referred to for effecting multicolor diffusion transfer processes comprises at least an aqueous solution of an alkaline material, for example sodium hydroxide, potassium hydroxide, and the like, and preferably possessing a pH in excess of 12, and most preferably includes a viscosity-increasing compound constituting a film-forming material of the type which, when the composition is spread and dried, forms a relatively firm and relatively stable film. The preferred film-forming materials comprise high molecular weight polymers such as polymeric, water-soluble ethers which are inert to an alkaline solution such as, for example, a hydroxyethyl cellulose or sodium carboxymethyl cellulose. Other film-forming materials or thickening agents whose ability to increase viscosity is substantially unaffected if left in solution for a long period of time also are capable of utilization. The film-forming material is preferably contained in the processing composition in such suitable quantities as to impart to the composition a viscosity in excess of 100 cps, at a temperature of approximately 24° C. and preferably in the order of 100,000 cps. to 200,000 cps. at that temperature.

In particularly useful embodiments of this invention, the transparent polymeric support contains a small quantity of a pigment, e.g., carbon black, to prevent fog formation due to light-piping by internal reflection within the transparent support, and subsequent exiting from the support surface carrying the photographic layers, of actinic light incident upon an edge thereof; such elements are described in Belgian Pat. No. 777,407. The transparent support advantageously may include an ultraviolet light absorber.

In the practice of this invention, a photosensitive element is exposed to a suitable multicolor step-wedge and diffusion transfer processed with a given processing composition and image-receiving element. The blue, green and red D log E curves of the resulting multicolor transfer image (control image) are prepared. Examination of these D log E curves will indicate to one skilled in color photographic sensitometry the manner and extent to which the individual D log E curves depart from the desired curve shape. From this examination, one may determine by routine analysis and experimentation how much filtration would be required or what wavelength range of ranges to obtain a more desirable color balance. The photosensitive element of another film unit, having the identical photosensitive element, image-receiving element and processing composition as used in obtaining the control image, is then given the same exposure through a conventional color correction filter(s) of the color and density estimated to be necessary to provide the desired changes in the D log E curves of the control image. The blue, green and red D log E curves of the resulting test multicolor transfer image are then prepared and compared with the control. While more than one "test" may be required to determine the color filtration most effective to give the desired D log E curve shape changes, such tests may be performed rapidly and easily. When the appropriate color filtration has been determined, a layer containing a color correction dye or dyes absorbing light in appropriate wavelength range(s) is coated on a transparent support at a coverage calculated to provide the requisite density. This "test" color correction dye layer is placed in the exposure path and the previous exposure test repeated. Analysis of the D log E curves of the resulting multicolor transfer image will indicate what changes, if any, should be made in the spectral absorption range and density prior to incorporating a corresponding color correction dye layer into the diffusion transfer film unit.

For purposes of illustrating the invention, a water-soluble, alkali-bleachable yellow dye of the formula:

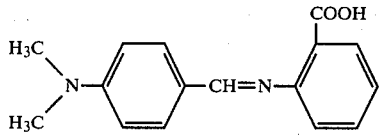

was selected. Test color correction filters were prepared by coating this dye in a polymeric binder layer over a transparent polyethylene terephthalate sheet at dye coverage of approximately 10 and 20 mg./ft.$^2$. The transmission densities of the resulting test filters were found to be very close to those of Eastman Kodak CC-5Y and CC-10Y gelatin filters:

| | Red | Green | Blue |
|---|---|---|---|
| CC-5Y | 0.07 | 0.11 | 0.21 |
| Test filter: 10 mg./ft.$^2$ | 0.09 | 0.11 | 0.18 |
| CC-10Y | 0.07 | 0.11 | 0.29 |
| Test filter: 20 mg./ft.$^2$ | 0.09 | 0.11 | 0.27 |

An integral negative-positive reflection print was prepared using a photosensitive element, image-receiving layer and processing composition similar to that described in Example 2 of U.S. Pat. No. 3,801,318 (issued Apr. 2, 1974 to Edwin H. Land, Stanley M. Bloom and Howard G. Rogers) except that the above yellow dye was added to the image-receiving layer in a quantity providing a dye coverage of approximately 45 mg./ft.$^2$. Inspection of the resulting multicolor integral negative-positive reflection print showed that the yellow color correction dye had been bleached. The changes in color balance were intermediate those which would be obtained by use of CC-20Y and CC-30Y color correction filters in front of the camera lens.

As noted in the above example, it is within the present invention to incorporate the color correction dye(s) in the image-receiving layer. The choice of location of the color correction dye(s) will depend in large part upon what stage of the manufacturing process the determination is made to incorporate such a color correction dye. As will be readily apparent, provision of the color correction dye(s) in a separate layer has the advantage of permitting modification after the components have fully "matured" and also permits different modification of portions of the same lot of the positive component.

The supports for the various layers may be any of the types known in the art to be useful. In the preferred embodiments wherein an integral negative-positive reflection print is obtained, the supports should be dimensionally stable and may be polyethylene terephthalate or other polymeric film base, as disclosed in the cross-referred patents.

It will be recognized that the transfer image formed following exposure and processing of film units of the type illustrated in FIG. 1 will be a geometrically reversed image of the subject. Accordingly, to provide geometrically non-reversed transfer images, exposure of such film units should be accomplished through an image reversing optical system, such as in a camera possessing an image reversing optical system utilizing mirror optics, e.g., as described in U.S. Pat. No. 3,447,437 issued June 3, 1969 to Douglas B. Tiffany.

Where the expression "positive image" has been used, this expression should not be interpreted in a restrictive sense since it is used primarily for purposes of illustration, in that it defines the image produced on the image-carrying layer as being reversed, in the positive-negative sense, with respect to the image in the photosensitive emulsion layers. As an example of an alternative meaning for "positive image", assume that the photosensitive element is exposed to actinic light through a negative transparency. In this case, the latent image in the photosensitive emulsion layers will be positive and the dye image produced on the image-carrying layer will be negative. The expression "positive image" is intended to cover such an image produced on the image-carrying layer, as well as transfer images obtained by use of direct positive silver halide emulsions to provide a "positive" image of the photographed subject.

It should now be apparent that this invention provides a method for maintaining the photographic consistency of a total diffusion transfer system, notwithstanding normal variations in manufacture and ageing of the components. The herein disclosed use of an incorporated color correction dye to modify and adjust the sensitometry of a multicolor system provides a very effective method of modifying the color balance of a multicolor diffusion transfer film. This method reduces the need for modification of the processing composition for use with manufacturing variants of the multicolor photosensitive element. The rebalancing method is one which permits maximum flexibility in the manufacturing and coating operations so that only a minimum of photosensitive material need be deemed unusable as "out of specification" with respect to color balance. The rebalancing method ideally is brought into operation at a relatively late stage of the film manufacturing operation, providing the ability to adjust after the photographic system has aged to equilibrium values.

Since certain changes may be made in the above product and process without departing from the scope of the invention herein involved, it is intended that all matter contained in the above description or shown in the accompanying drawings shall be interpreted as illustrative and not in a limiting sense.

What is claimed is:

1. The method comprising the steps of:

making a first test exposure of a multicolor photosensitive element to a multicolor step-wedge, said multicolor photosensitive element comprising a support carrying a red-sensitive silver halide emulsion, a green-sensitive silver halide emulsion, and a blue-sensitive silver halide emulsion, said silver halide emulsions having associated therewith, respectively, a cyan image dye-providing material, a magenta image dye-providing material and a yellow image dye-providing material, said image dye-providing materials being image dyes or image dye intermediates;

forming a first test multicolor diffusion transfer image by diffusion transfer processing of said exposed multicolor photosensitive element;

preparing blue, green and red D log E curves of said first test multicolor diffusion transfer image and determining from said curves the amount of filtration of which wavelength range or ranges would be required to obtain a more desirable color balance;

making a second test exposure and forming a second test multicolor transfer image using the same multicolor photosensitive element, image-receiving layer and diffusion transfer processing composition under the same exposure conditions as said first test exposure except that said second exposure is effected through a color correction filter or filters of the color and density estimated from said first test exposure to be necessary to provide said filtration necessary to obtain said more desirable color balance;

repeating said second test exposure and forming another test multicolor transfer image with a different color correction filter(s) set until the color correction effective to give the desired D log E curve shape changes is determined;

coating on a transparent non-photosensitive element a color correction layer containing color correction dye or dyes exhibiting the appropriate wavelength range(s) absorption and transmission density to substantially provide said desired color correction;

assembling said multicolor photosensitive element in superposed relationship with said non-photosensitive element into a film unit including a rupturable container releasably retaining an aqueous alkaline processing composition, said pod being positioned to release said processing composition for distribution between the opposed surfaces of said multicolor photosensitive element and said non-photosensitive element, whereby photoexposure of said photosensitive element will be effected through said non-photosensitive element including said color correction layer;

said film unit including an image-receiving layer in one of said elements, said image-receiving layer being viewable through a transparent support for the element containing said image-receiving layer, said film unit including means providing a layer of a white pigment between said image-receiving layer and the silver halide emulsions of said multicolor photosensitive element whereby the image formed in said image-receiving layer may be viewed against a light-reflecting layer provided by said white pigment without separating said elements after photoexposure and processing, said multicolor photosensitive element, image-receiving layer and processing composition being of the same composition as used in said test exposures;

said color correction dye(s) not being visible with the multicolor diffusion transfer image formed in said film unit.

2. The method as defined in claim 1 wherein said color correction dye(s) is bleachable by said processing composition.

3. The method as defined in claim 1 wherein said color correction dye(s) is non-diffusible to said image-receiving layer.

* * * * *